US006373176B1

(12) United States Patent
Ge et al.

(10) Patent No.: US 6,373,176 B1
(45) Date of Patent: Apr. 16, 2002

(54) DISPLAY DEVICE WITH IMPROVED GRID STRUCTURE

(75) Inventors: Shichao Ge; Charles S. Leung, both of San Jose; Lap Man Yam, Saratoga, all of CA (US)

(73) Assignee: Pixtech, Inc., Santa Clara, CA (US)

( * ) Notice: Subject to any disclaimer, the term of this patent is extended or adjusted under 35 U.S.C. 154(b) by 0 days.

(21) Appl. No.: 09/138,226

(22) Filed: Aug. 21, 1998

(51) Int. Cl.[7] ..... H01J 29/81

(52) U.S. Cl. ..... 313/402; 313/408; 313/495; 313/422

(58) Field of Search ..... 313/402, 404, 313/405, 407, 408, 309, 346 R, 495, 496, 497, 422, 581, 585

(56) References Cited

U.S. PATENT DOCUMENTS

| | | | | |
|---|---|---|---|---|
| 3,935,500 | A | | 1/1976 | Oess et al. |
| 4,308,485 | A | | 12/1981 | Ignazio |
| 4,789,805 | A | | 12/1988 | Baselmans et al. |
| 4,973,888 | A | | 11/1990 | Morimoto et al. |
| 5,083,058 | A | | 1/1992 | Nonomura et al. |
| 5,160,871 | A | | 11/1992 | Tomii et al. |
| 5,191,217 | A | | 3/1993 | Kane et al. |
| 5,229,691 | A | | 7/1993 | Shichao et al. |
| 5,347,201 | A | | 9/1994 | Liang et al. |
| 5,402,143 | A | | 3/1995 | Ge et al. |
| 5,430,347 | A | | 7/1995 | Kane et al. |
| 5,507,677 | A | | 4/1996 | Michalchuk |
| 5,561,343 | A | | 10/1996 | Lowe |
| 5,634,837 | A | | 6/1997 | Nishimura et al. |
| 5,973,452 | A | * | 10/1999 | Bojkov et al. ..... 313/495 |

* cited by examiner

*Primary Examiner*—Ashok Patel
(74) *Attorney, Agent, or Firm*—Samuels, Gauthier & Stevens, LLP

(57) ABSTRACT

A rim made of glass or ceramic material is attached to an alloy sheet with through holes therein at an elevated temperature. Voltages applied to the sheet may be used for focusing electrons passing there through onto a phosphor layer for displaying images. An optional insulating layer is formed on the sheet and optional grid electrodes are formed on the insulating layer for addressing and focusing. Upon cooling, the rim maintains the alloy sheet in tension. Holes in the alloy sheet and the grid electrodes are therefore maintained in proper alignment with cathodes and pixel dots despite temperature variations. The rim also forms a portion of the side wall of the display device, so that once the rim has been aligned with and attached to a cathode plate and face plate, the accurate alignment process has been completed and the assembly of the device is much simplified. By employing a thin rim and substrate, the combined electrode structure may be as thin as 3 millimeters or less, so that the distance between the face and back plates is no more than 10 millimeters, suitable for an ultrathin large screen display.

61 Claims, 9 Drawing Sheets

DISPLAY DEVICE WITH IMPROVED GRID STRUCTURE

DISCLOSURE DOCUMENT

This application is related to Disclosure Document No. 425,240, filed Oct. 7, 1997. It is understood that this Document will be placed in and become a part of the file wrapper of this application.

BACKGROUND OF THE INVENTION

This application relates in general to display devices and, in particular, to a display employing an improved structure for grid electrodes so that the grid electrodes may be kept in precise position.

In image display devices such as a color television, a mask and electrical potentials applied thereto are used for controlling the paths of electrons directed towards particular pixel locations on the television screen despite temperature changes. Therefore, it is important to maintain the position of a mask in precise alignment relative to pixel positions on the phosphor layer. Thus, U.S. Pat. No. 4,308,485, for example, discloses a mask made of a thin metallic plate having an edge fixed to a profiled metallic frame having the general shape of an angle iron with two branches. The edge of the mask is fixed onto one branch of the frame and the other branch of the frame is attached to the inner surface of the front part of the color television tube. It is stated that, dilatations of the mask are absorbed by the edges of the mask, where the edges are between bosses, so that temperature variations of the mask have minimal effects on the position of the mask.

U.S. Pat. No. 4,789,805 illustrates another type of shadow mask suspended from the glass envelope of a cathode array tube by spring steel suspension elements which are connected to a glass envelope, such as that in a cathode ray tube, by metal connectors which are plastically deformed at low temperatures to avoid thermal stresses on the glass. Another mechanism for mounting the mask onto a cathode array tube is described in U.S. Pat. No. 5,634,837. In this patent, positioning posts fixed on a back plate and positioning pins extending from a face plate are engaged to align the face and back plates. The shadow mask has openings through which the positioning posts extend so as to position the mask with respect to the back plate.

After a shadow mask has been mounted onto a face plate assembly, a sealing process of the face plate to the funnel of a cathode array tube at high temperature may cause the grid wires in the mask to permanently expand and, therefore, sag. U.S. Pat. No. 5,507,677 discloses a method for pre-stressing the mask so that the grid wires therein will experience only a small additional creep during such high temperature sealing process.

While the above-described mechanisms and methods for maintaining alignment of a mask may be useful for cathode array tube applications, they are usually too bulky and cumbersome for use in flat panel displays. In order to be able to precisely align a mask using the above-described alignment mechanisms, such mechanisms are usually required to be of a certain size. In many flat panel displays, it is desirable to keep the distance between the face and back plates of the display at a small value, typically of the order of several millimeters or less. Given such spacing in a flat panel display, it is impractical to use the above-referenced mounting mechanisms or methods for cathode array tubes. It is, therefore, desirable to provide an improved design for mounting grid electrodes so that these electrodes can be precisely positioned with respect to other elements of the display.

SUMMARY OF THE INVENTION

Temperature variations of grid or focusing electrodes may cause the electrodes to expand or contract and, consequently, misalign with respect to the pixels of the display. By causing the grid or focusing electrodes to be under tension that is maintained by means of a rim during the operation of the display, the effect of temperature variations on the alignment of the grid electrodes is much reduced. Therefore, one aspect of the invention is directed towards an electrode structure where the structure includes a rim and an electrode connected to the rim. The electrode comprises a layer of electrically conductive material that is in tension. The rim causes tension in the layer to be maintained. The electrode structure has a thickness not more than about 10 millimeters, so that when it is placed between an anode or on or near a front face plate and at least one cathode, the distance between the front face plate and a back plate beyond the cathode can be maintained to be quite small; in the preferred embodiment, this distance may be no more than 20 millimeters. When electrical potentials are applied to the anode, the at least one cathode and the layer, electrons are directed to desired portions of a luminescent layer at or near the anode for displaying images.

According to another aspect of the invention, an electrode structure is employed between an anode and at least one cathode. The structure includes a rim and an electrode connected to the rim, where the electrode includes a layer of electrically conductive material under tension. The rim causes tension in the layer to be maintained. The layer and the rim have different thermal coefficients of expansion so that the tension may be maintained despite temperature changes. The front and back plates of the display device are spaced apart by not more than 20 millimeters, so that electrons may be controlled to be directed to precise pixel dot locations for improved resolution. The layer may be used for focusing electrons to desired portions of a luminescent layer at or near the anode for displaying images.

The prior art mounting mechanisms referred to above for cathode array tubes are cumbersome and time consuming. Thus, according to another aspect of the invention, the electrode structure of a flat panel display device has a rim, an electrode connected to the rim, where the electrode includes a layer of electrically conductive material having holes therein for focusing electrons. The rim forms at least a portion of a sidewall structure connected to a face and a back plate to form a sealed vacuum chamber housing an anode and at least one cathode. This flat panel display device is particularly simple to assemble. In one embodiment, once the rim of the electrode structure has been aligned with respect to the front face plate and the back plate in assembly of the sidewall structure with the face and back plates, the layer will be automatically aligned with respect to the front face plate and the back plate. Thus, such method of assembly is much simpler compared to the conventional mounting and alignment processes referred to above for cathode array tubes.

Another aspect of the invention is a method for making a flat panel display. A layer of electrically conductive material having holes therein is formed. The layer is fixed relative to a rim at a temperature above an operating temperature of the display to form an electrode structure. The layer has a thermal coefficient of expansion that is larger than that of the rim. Temperature(s) of the layer and rim is reduced to cause the layer to be under tension. The electrode structure is placed between and aligned with an anode on or near a front face plate and at least one cathode. The position of the electrode structure relative to a front and a back plate is then caused to be set to form a flat panel display device.

Another aspect of the invention is directed to a cathode ray tube display device comprising a front face plate; an anode on or near the front face plate; a first layer of luminescent material on or near the anode; and an electron gun. The electron gun preferably comprises a cathode, a funnel enclosing the cathode and means for deflecting an electron beam from the cathode. An electrode structure is placed between the anode and the cathode, said structure including a rim and an electrode connected to the rim, said electrode comprising a second layer of electrically conductive material under tension, wherein the rim causes tension to be maintained in said second layer, said electrode structure having a thickness not more than about 10 millimeters. When electrical potentials are applied to the anode, the second layer, the cathode and the deflecting means, electrons from the cathode are caused to reach desired portions of the luminescent layer for displaying images.

BRIEF DESCRIPTION OF THE DRAWINGS

For simplicity in description, identical components are labelled by the same numerals in this application.

DETAILED DESCRIPTION OF THE PREFERRED EMBODIMENT

Figure 1:
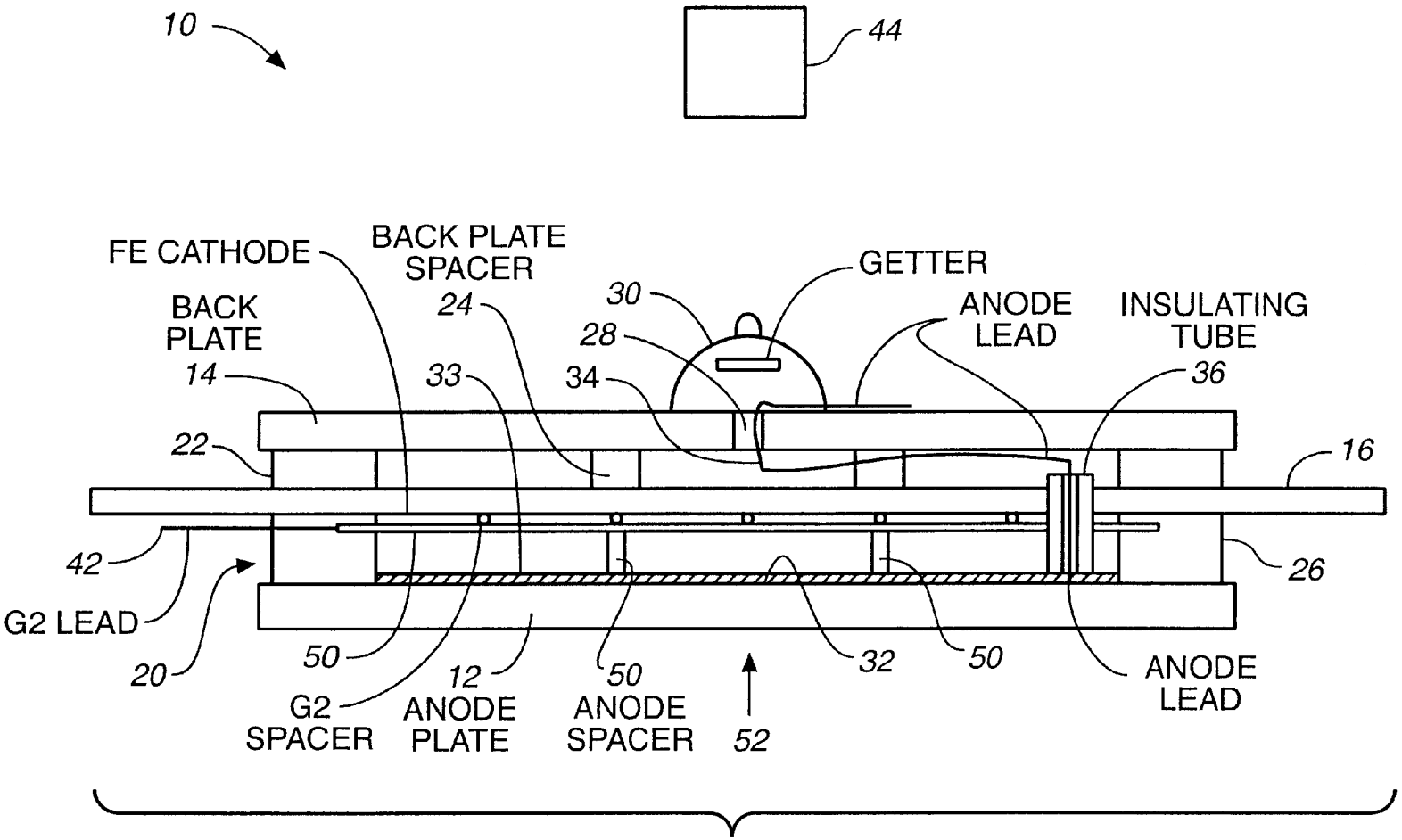
FIG. 1 is a cross-sectional view of a flat panel display device employing field emitter cathodes to illustrate a preferred embodiment of the invention.

FIG. 1 is a cross-sectional view of a flat panel display device 10 to illustrate the preferred embodiment of the invention. Device 10 includes a face plate 12 and a back plate 14. The anode 32 may be located on or near the inside surface of the front face plate 12; in the preferred embodiment, the anode is formed on the inside surface of the face plate. A layer of phosphor 33 comprising a two dimensional array of sets of phosphor dots for displaying red, green and blue light when impinged upon by electrons is formed on the anode. Each set of phosphor includes at least one phosphor dot; in the preferred embodiment, each set may include three dots (such as a first dot emitting red, a second one green and the third one blue light) or four dots (such as a first dot emitting red, a second and a third one green and a fourth one blue light). Sandwiched between the front face and back plate is a cathode plate 16 onto which a two dimensional array of sets of field emitter (FE) cathodes have been fabricated on the surface of plate 16 facing the anode. In between the cathode plate 16 and the front plate 12 is an electrode structure 20 shown more clearly in FIGS. 2A and 2B. The cathode plate 16 is separated from the back plate by sealing wall 22 and back plate spacers 24 attached to the cathode and back plates. As described in more detail below, the electrode structure 20 has a rim or sealing wall 26 which also serves as a portion of the side wall structure of device 10, where the rim 26 is attached in the preferred embodiment to the inside surface of the front face plate 12 and attached by an adhesive means such as glass frit to the cathode plate.

Electrode structure 20 includes a layer 50 of electrically conductive material with holes therein (the layer preferably in the form of a mesh), where each hole overlaps and matches a set of one or more pixel dots, or a portion thereof, of the phosphor layer 33 and a corresponding set of cathodes when viewed from the viewing direction 52 in FIG. 1. When a voltage is applied to layer 50, electrons generated by the cathodes and passing through one or more holes in layer 50 are focused onto the corresponding and overlapping pixel dot or dots. Electrons generated by the cathodes may be directed to the holes in a number of ways as described below.

Thus, rim 26, sealing wall 22 and the front and back plates 12, 14 enclose therein a sealed chamber which may be evacuated through a hole 28 in the back plate through a getter structure 30. The anode 32 on the inside surface of the front face plate 12 is connected by means of wire 34 to the back surface of the back plate through an insulating tube 36 in the electrode structure and the cathode plate 16 and through the hole 28. Conductive traces (not shown in the figures) are formed on the same side of cathode plate 16 as the array of FE cathodes for controlling the cathodes and the operation of device 10. The leads 42 for controlling the electrical potential of the conductive layer of electrode structure 20 (not shown), with the traces on the cathode plate 16 and wire 34, are connected to a controller and power supply 44 which causes desired and appropriate electrical potentials to be applied to the anode, the conductive layer in structure 20 and cathodes for operating device 10.

The pixel elements or dots on the phosphor layer on anode 32 for emitting red, green and blue light are preferably aligned with the holes in the conductive layer 50 of the electrode structure 20 and with the rows of FE cathodes on the cathode plate 16 when viewed from the viewing direction 52 in FIG. 1. Controller/power supply 44 applies appropriate electrical potentials to the anode, columns and/or rows of FE cathodes and layer 50 (also referred to as G2) in structure 20 to cause electrons emitted by the cathodes to reach desired pixel dots on the anode for displaying images. In one embodiment, scanning electrical potentials are applied sequentially to rows of FE cathodes and data electrical potentials are applied to columns of the FE cathodes for controlling brightness to accomplish XY addressing. The application of scanning or addressing electrical potentials and data electrical potentials to FE cathodes for providing video displays is known to those in the industry and need not be further elaborated here.

Figure 2A:
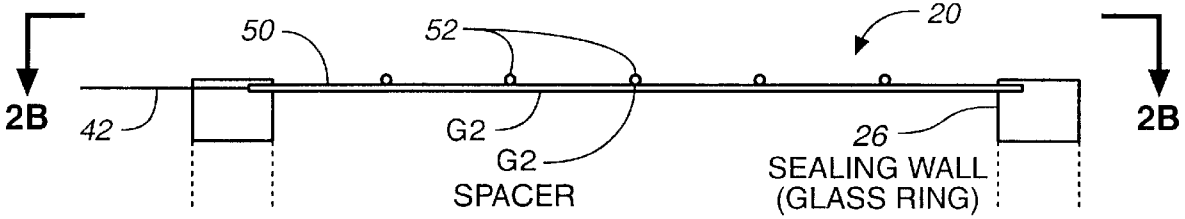
FIG. 2A is a cross-sectional view of the electrode structure of the flat panel display of FIG. 1.
Figure 2B:
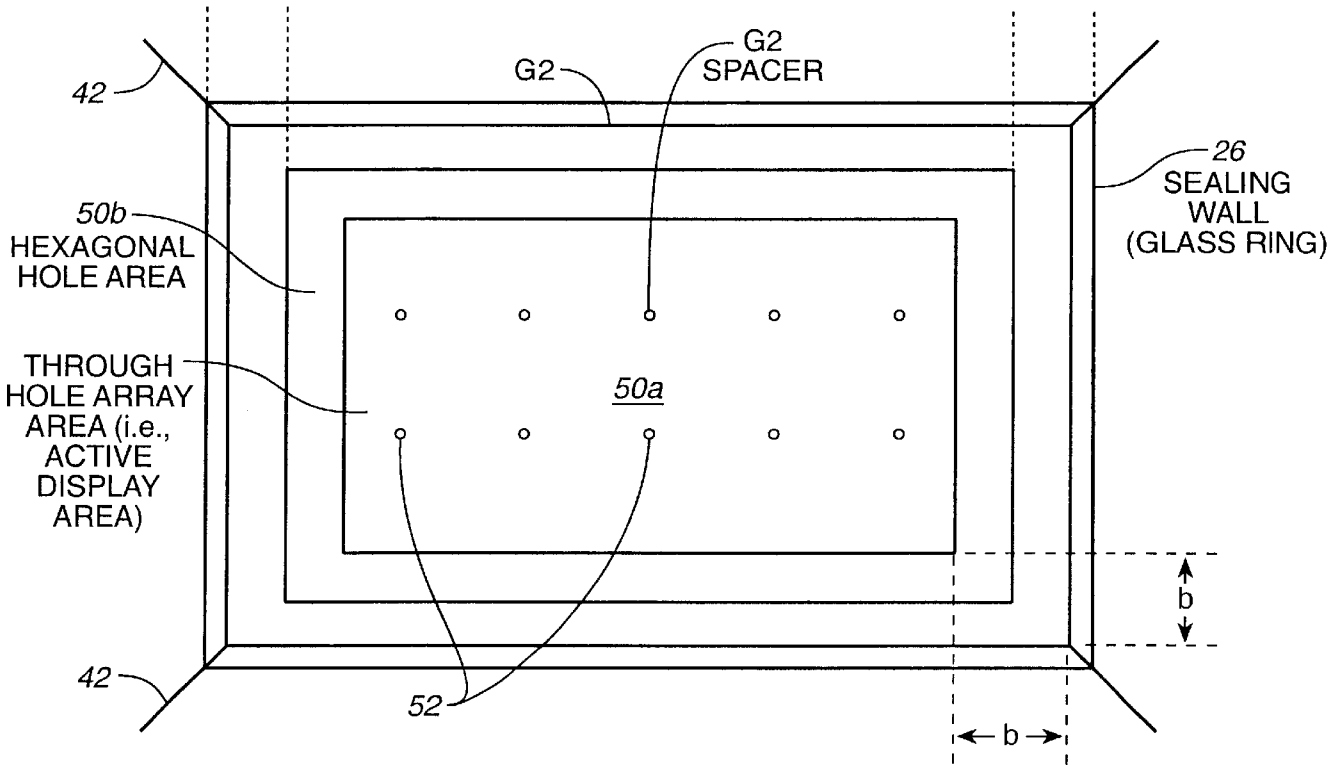
FIG. 2B is a view along the lines 2B—2B in FIG. 2A of the electrode structure.

Electrode structure 20 is illustrated more clearly in FIGS. 2A and 2B, where FIG. 2B is a view of the structure of FIG. 2A along the line 2B—2B in FIG. 2A, and where tube 36 has been omitted to simplify the figures. As shown in FIGS. 2A and 2B, the electrode structure 20 includes a rim 26 which is attached to an electrically conductive layer 50. Layer 50 may comprise a sheet of metal with through holes therein. Leads 42 are connected (not shown) to controller/power supply 44. As shown in FIG. 2B, layer 50 comprises a center area 50*a* with through holes therein. Surrounding center area 50*a* is a perimeter area 50*b* which comprises a narrow strip of material of width b also with through holes therein, where the strip 50*b* acts as a spring for maintaining tension in the center portion 50*a*. In the preferred embodiment, the perimeter area 50*b* and center area 50*a* form an integral unitary structure 50; preferably areas 50*a*, 50*b* may be formed by etching holes through a single sheet of metal. Alternatively, area 50*b* may be a strip of metal attached to center area 50*b* to form the layer 50. The holes in area 50*b* are typically of a different size and may be of a different shape than those in area 50*a*, since those in area 50*b* are to cause the area 50*b* to act as a spring whereas those in area 50*a* are to match and at least partially overlap corresponding pixel dots for accomplishing electron focusing and imaging. Preferably, the holes in the strip 50*b* are hexagonal, circular, square or elliptical in shape. While a strip of metal 50*b* is employed to act as a spring for maintaining tension in the center portion 50*a* (and in grid electrodes, if any, as elaborated below), it will be understood that springs of other types and shapes may be used while retaining the advantages of the invention. Electrode structure 20 is formed preferably by attaching rim 26 to one side of area 50*b* at or closer to its outside edge.

After electrode structure 20 has been assembled, rim 26 of the structure is attached to the inner surface of the face plate by means of glass frit. As shown more clearly in FIG. 2B, area 50*b* overlaps a large portion of the sealing wall or rim 26, where the overlapping area is shown in black or dark cross-hatching, the non-overlapping portion of rim 26 shown as clear and the non-overlapping portion of the area 50*b* shown as lighter cross-hatched. Rim 26 is slightly larger than area 50*b*, so that a small perimeter area (not cross-hatched in FIG. 2B) of the rim extending beyond the layer 50 is reserved for glass frit. When glass frit is used to attach the layer to the rim, a small amount of extra glass frit usually escapes from the space between the rim and electrode and appears as a ring of glass frit beads on the edge of layer 50. Such ring may be used to seal the outer edge of the layer 50 against the rim 26 and the cathode plate 16 to form a portion of a sidewall structure. In the preferred embodiment, a sealing vacuum chamber is formed by attaching a sidewall structure (formed by a portion of the cathode plate, a sealing wall 22, and the rim 26 of structure 20) to the face and back plates by means of glass frit.

Rim 26 causes tension in areas 50*a*, 50*b* of the layer 50 to be maintained despite temperature changes so as to maintain the accurate alignment between the holes in area 50*a*, the phosphor pixel dots on anode 32, and the FE cathodes. Rim 26 is preferably made of a material having a different thermal coefficient of expansion compared to that of layer 50. In one embodiment, the thermal coefficient of rim 26 is smaller than that of layer 50 in at least the temperature range of 25 to 300° C. In such embodiment, the rim 26 is attached to portion 50*b* at an elevated temperature, such as a temperature above about 365° C. in an oven. When the temperature(s) of the rim and electrode is subsequently reduced, such as by withdrawing the electrode structure from an oven, the layer 50 contracts more than the rim, so that the layer 50 is placed in tension. If the rim is attached to the layer 50 at a temperature above the normal operating temperature of device 10, even when the rim and layer 50 are at an elevated temperature due to the heat generated by operation of the device 10, the rim 26 maintains the layer 50 in tension, so that temperature changes of device 10 will not cause the layer 50 to sag, thereby maintaining the precise alignment between the holes in portion 50*a* of the layer 50 with the array of FE cathodes on the cathode plate and with the pixel elements or dots on the phosphor layer 33 on anode 32.

In one embodiment, layer 50 is made of an alloy sheet, and the rim 26 comprises glass or a ceramic material. In such event, the alloy sheet, the rim 26 and the frit glass used to attach layer 50 to the rim 26 may have the following thermal expansion coefficients as listed in the table below:

| Materials | Thermal Expansion Coefficient (25–300° C.) ($\times 10^{-7}$/° C.) |
|---|---|
| Alloy Sheet | 10–120 |
| Frit Glass | 10–250 |
| Rim | 10–250 |

The alloy sheet 50, preferably, includes at least 40% nickel; preferably the alloy sheet 50 has 40–52 wt. % Ni, 6 wt. % or less Cr, 0.6 wt. % or less Mn, 0.25 wt. % or less Si, 0.05 wt. % or less C, and balance with Fe. Preferably, the rim 26 comprises glass or other insulating material having a thickness less than 10 millimeters, and more preferably less than 3 millimeters. In one embodiment, rim 26 is 1.5 millimeters thick. The thickness of layer 50 is typically less than that of the rim 26. The thickness of the thickest portion(s) of the electrode structure 20 shown in FIGS. 2A and 2B, such as that of the rim 26, is preferably no more than 10 millimeters. Where the electrode structure 20 has such thickness, the spacing between the front face plate 12 and the back plate 14 can be maintained to be not more than 25 millimeters, or more preferably not more than 20 millimeters, for an ultra-thin flat panel display. In one embodiment, the spacing is about 10 millimeters.

Figures 3A, 3B:
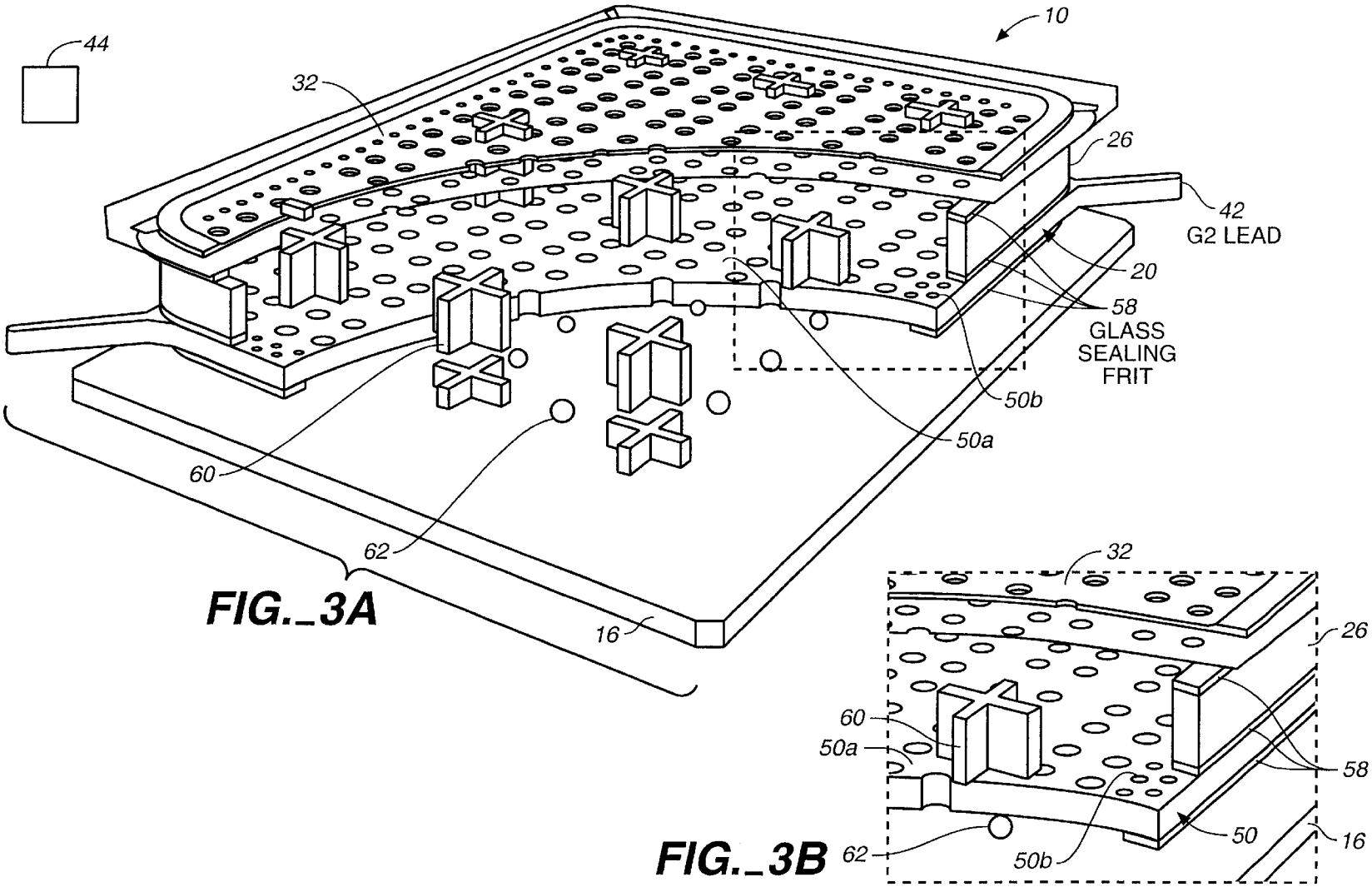
FIG. 3A is a perspective view of the electrode structure of FIGS. 1, 2A and 2B with a portion cut away and of the cathode plate of FIG. 1.
FIG. 3B is an exploded view of a portion of the device in FIG. 3A.

FIG. 3A is a perspective view of a portion of the flat panel display device 10 of FIGS. 1, 2A and 2B with a portion cut away. FIG. 3B is an exploded view of a portion of the device in FIG. 3A Sealing wall 22 is attached to the cathode plate 16 on one side and to the back plate 14 on the other side after wire 34 has been installed as described above in reference to FIG. 1. Rim or sealing frame 26 may be attached to the anode plate and to layer 50 by means of glass sealing frit 58. Anode spacers 60 may be attached to the layer 50 and the anode 32 by means of glass sealing frit. For ease of assembly, these anode spacers may first be attached to layer 50, so that the rim 26 and anode spacers 60 may be attached to the anode or anode plate in a single process. Cathode spacers 62 may also be formed on layer 50. The perimeter portion 50*b* of layer 50 and cathode spacers 62 may then be attached to the cathode plate 16 also in a single process. When structure 20 is attached to the anode and cathode plates, the layer 50 is properly aligned with the rows and/or columns of FE cathodes on the cathode plate 16 and with pixel dots on the anode. Once so aligned and the electrode structure 20 is attached to the cathode and anode plates, accurate alignment has been accomplished and temperatures changes will not cause misalignment because layer 50 is under tension. The rim 26 maintains the layer 50 and its portion 50*a* in tension to achieve such result.

Figure 4:
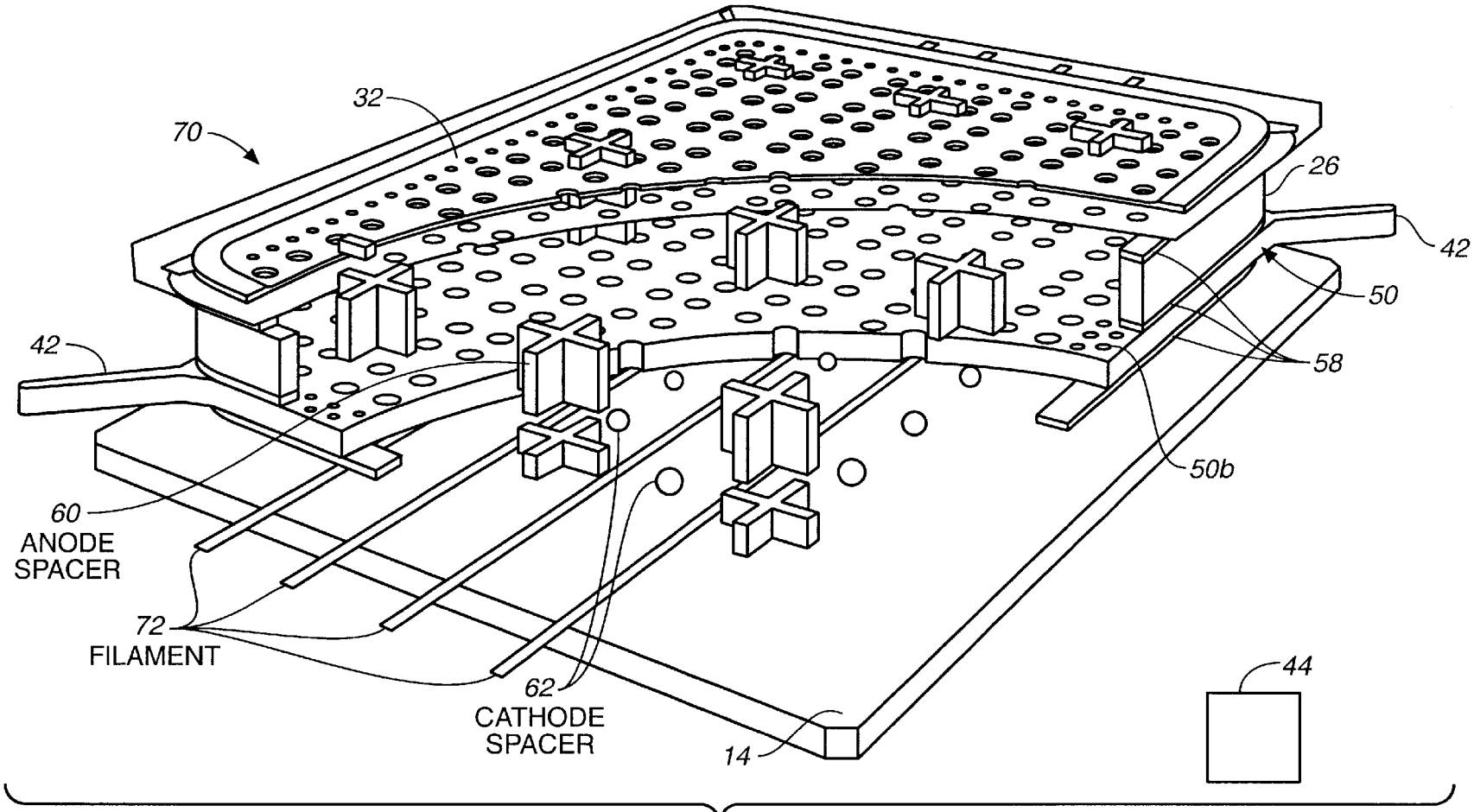
FIG. 4 is a perspective view of a portion of a flat panel display device similar to that shown in FIGS. 1, 2A, 2B, 3A and 3B, except that hot filament cathodes are used instead of field emitter cathodes to illustrate another embodiment of the invention.

FIG. 4 is a perspective view of a portion of a flat panel display device 70 that is similar to that shown in FIGS. 1, 2A, 2B, 3A and 3B, except that hot filament cathodes 72 are used instead of field emitter cathodes, and that control grid electrodes are used for addressing and brightness control, to illustrate another embodiment of the invention. The filaments 72 are first mounted and attached to back plate 14. Then, the holes in layer 50 are aligned with control grid electrodes (not shown) and to pixel dots or elements on phosphor layer 33 (shown in FIG. 1). Aside from such difference, the assembly process of structure 70 shown in FIG. 4 is substantially the same as structure 10 of FIGS. 1, 2A, 2B, 3A, 3B. Since FE cathodes are not used, the cathode plate may be omitted, and the layer 50 and the cathode spacers 62 attached directly to the back plate 14 instead of to a cathode plate by means of glass sealing frit 58. However, to allow space between the structure 20 and the back plate 14 for the filaments and control grid electrodes (described below), another sidewall (not shown in FIG. 4) similar to sealing wall 22 of FIG. 1 serving as a part of the side wall structure may be employed between the structure 20 and the back plate 14. Thus, the electrode structure 20 of FIGS. 1, 2A, 2B, 3A, 3B may also be used for a flat panel display employing not FE cathodes, but filament-type hot cathodes. Instead of connecting the array of FE cathodes as in device 10 to a power supply, the filaments 72 are connected instead to the controller/power supply 44. Scanning or addressing electrical potentials may be applied sequentially by controller/power supply 44 to a first group of one or more sets of control grid electrodes (not shown) and data electrical potentials may be applied to a second group of one or more sets of control grid electrodes (not shown) for controlling brightness in the same manner as that described in U.S. Pat. No. 5,229,691, which is incorporated herein in its entirety by reference. An electrical potential is also applied to layer 50 for focusing the electrons through the holes therein onto corresponding pixel dots or elements. The use of a focusing and imaging layer 50 maintained in tension in the display of U.S. Pat. No. 5,229,691 improves its contrast and performance.

Figure 5:
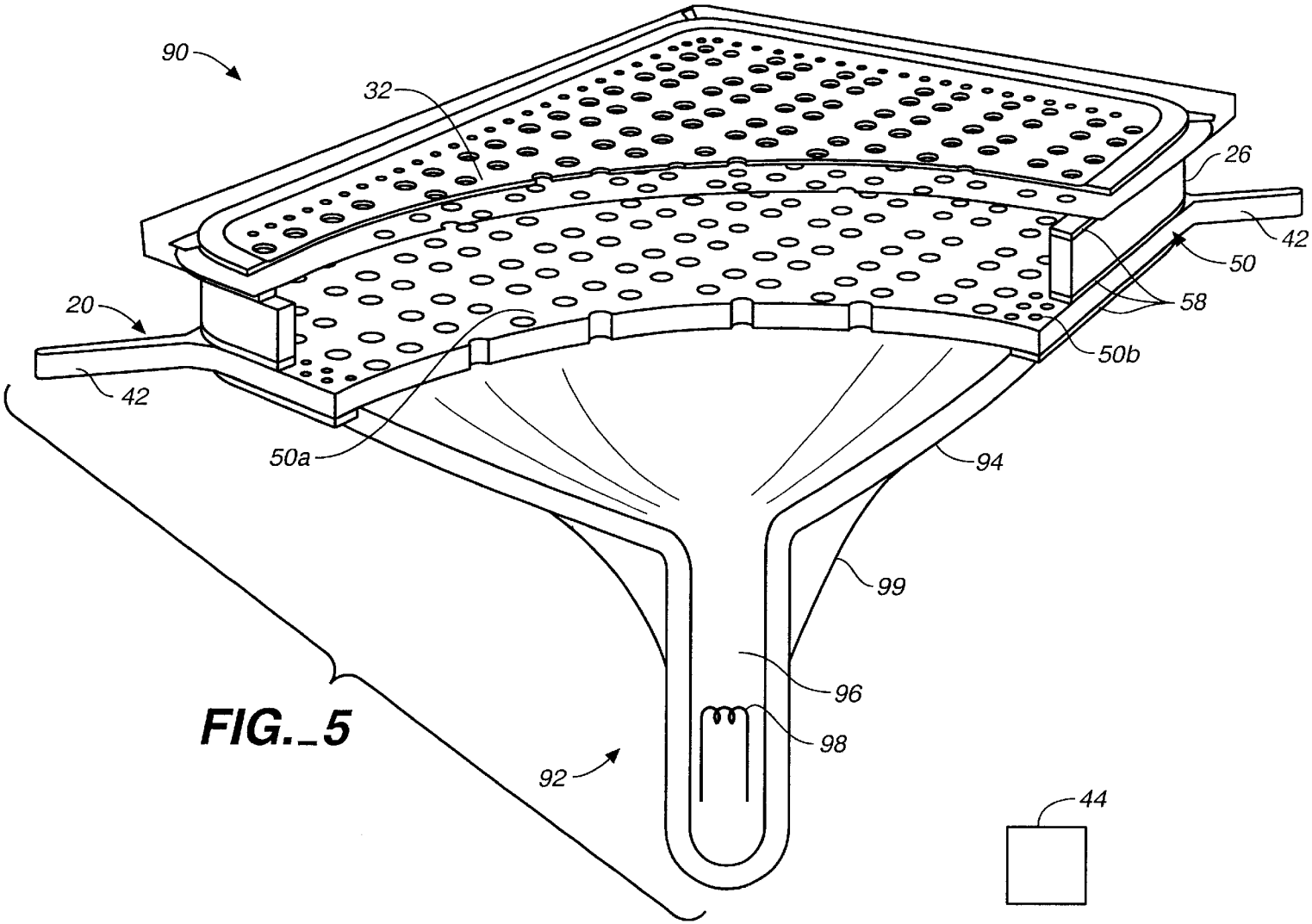
FIG. 5 is a perspective view of a display device employing an electron gun and an electrode structure similar to that of FIGS. 2A, 2B, 3A, 3B and 4, where a cathode ray tube type electron gun is used instead of field emitter cathodes or hot filament cathodes to illustrate yet another embodiment of the invention.

FIG. 5 is a perspective view of electrode structure 20 with a portion cut off and a cathode ray tube type electron gun 92 to form a display device 90 for illustrating yet another embodiment of the invention. Rather than using a number of parallel filaments 72 as in FIG. 4, an electron gun 92 is used. Gun 92 comprises a funnel shaped housing 94 with a neck 96 which encloses an electron source 98. Electrons emitted by the source 98 are deflected by the magnetic fields generated by a yoke 99, focused by the voltage applied to layer 50 , and directed towards the appropriate pixel dots in a manner known to those skilled in the art. Source 98, layer 50, anode 32 and yoke 99 are connected (not shown) to a controller such as controller/power supply 44 for controlling the operation of device 90. Layer 50 replaces the shadow mask used in conventional cathode ray tube devices; layer 50 is, however, much easier to make and install, and is less subject to misalignment due to temperature or other environmental changes. Obviously, means other than a yoke for deflecting the electron beam from source 98, such as deflection plates, may be used and are within the scope of the invention.

Figure 6A:
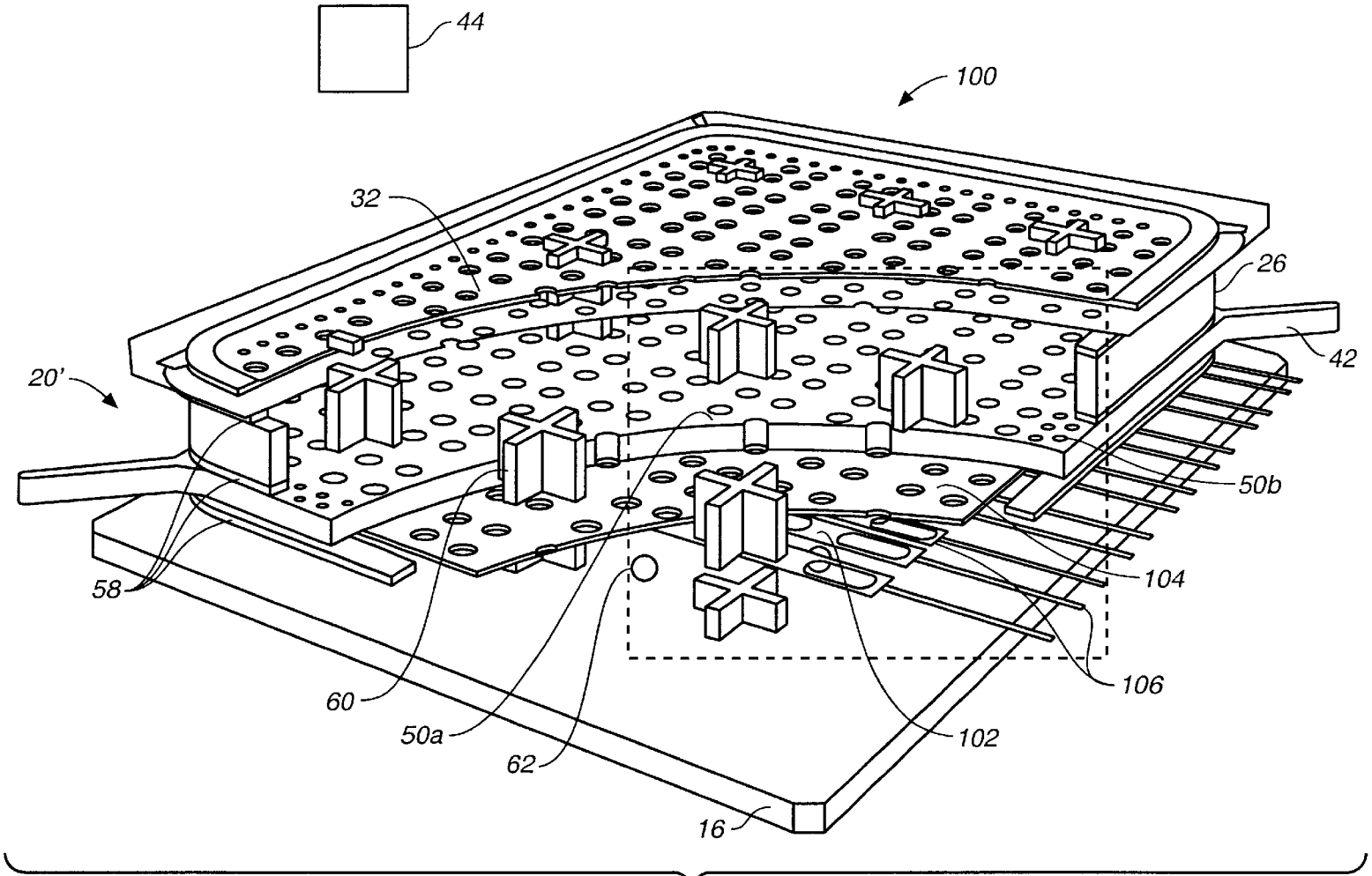
FIG. 6A is a perspective view of a portion of a flat panel display device that is similar to that shown in FIGS. 1, 2A, 2B, 3A, 3B except that device further includes an array of grid electrodes to illustrate another embodiment of the invention.
Figure 6B:
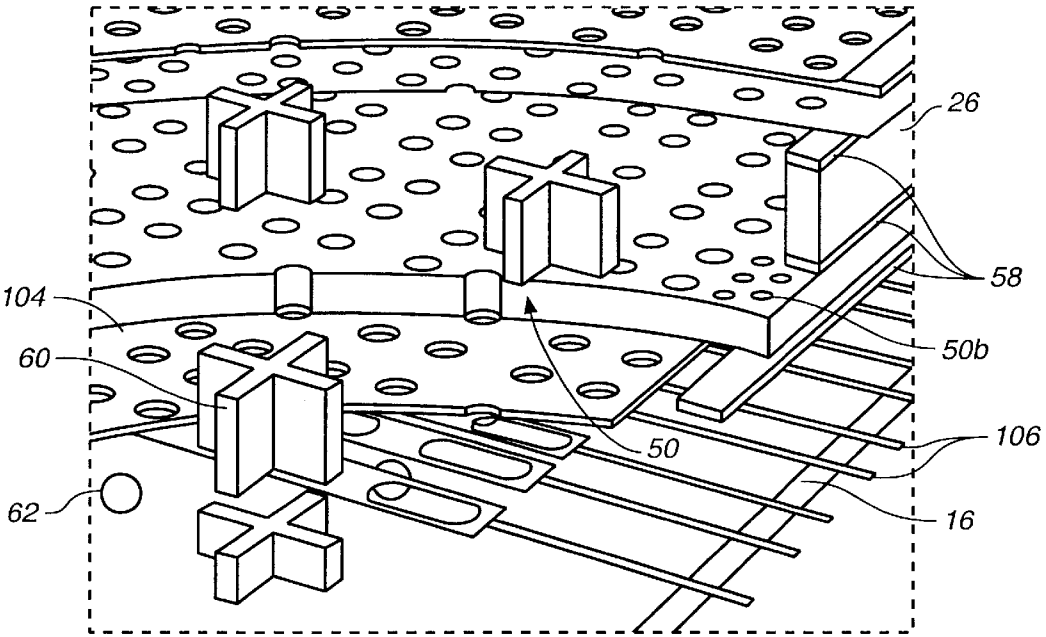
FIG. 6B is an exploded view of a portion of the device of FIG. 6A.

FIG. 6A is a perspective view of a portion of a flat panel display device 100 that is similar to that shown in FIGS. 1, 2A, 2B, 3A, 3B except that device 100 further includes an array of grid electrodes 102 to illustrate another embodiment of the invention. In the embodiment of FIGS. 1, 2A, 2B, 3A, 3B, the device is operated by applying scanning or addressing voltages to rows (or columns) of field emitter cathodes and data voltages are applied to columns (or rows) of such cathodes. In some applications, it may be desirable to use the FE cathodes only for scanning (i.e. addressing) and not for brightness control or only for brightness control and not for scanning. In such event, it would be desirable to further include grid electrodes 102 in device 100, so that the array of FE cathodes is used for addressing only or for brightness control only, not both; the same is true for the array of grid electrodes 102. For this purpose, an insulating layer 104 is formed on layer 50 of an electrically conductive material. Then a patterned layer 102 of an array of grid electrodes is formed on layer 104. Conductive leads 106 connect (not shown) the grid electrodes 102 to controller/power supply 44. Controller/power supply 44 applies suitable voltages to the anode, cathodes, focusing layer 50 and grid electrodes 102 for displaying desired video images and/or text. FIG. 6B is an exploded view of a portion of device 100 of FIG. 6A. The layer 50 of electrically conductive material, the insulating layer 104, the grid electrode layer 102, together with the rim 26, form the electrode structure 20'.

Figure 7:
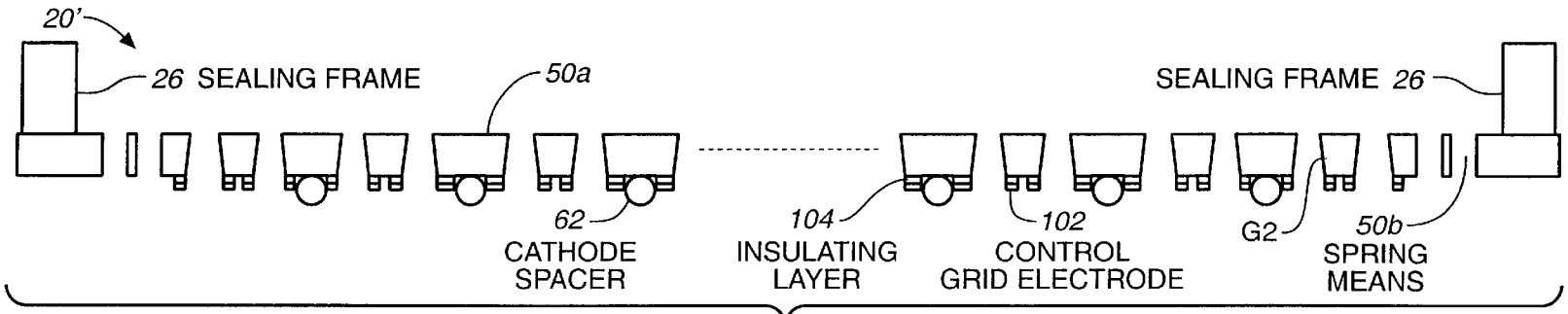
FIG. 7 is a cross-sectional view of the electrode structure of FIGS. 6A, 6B.
Figure 8:
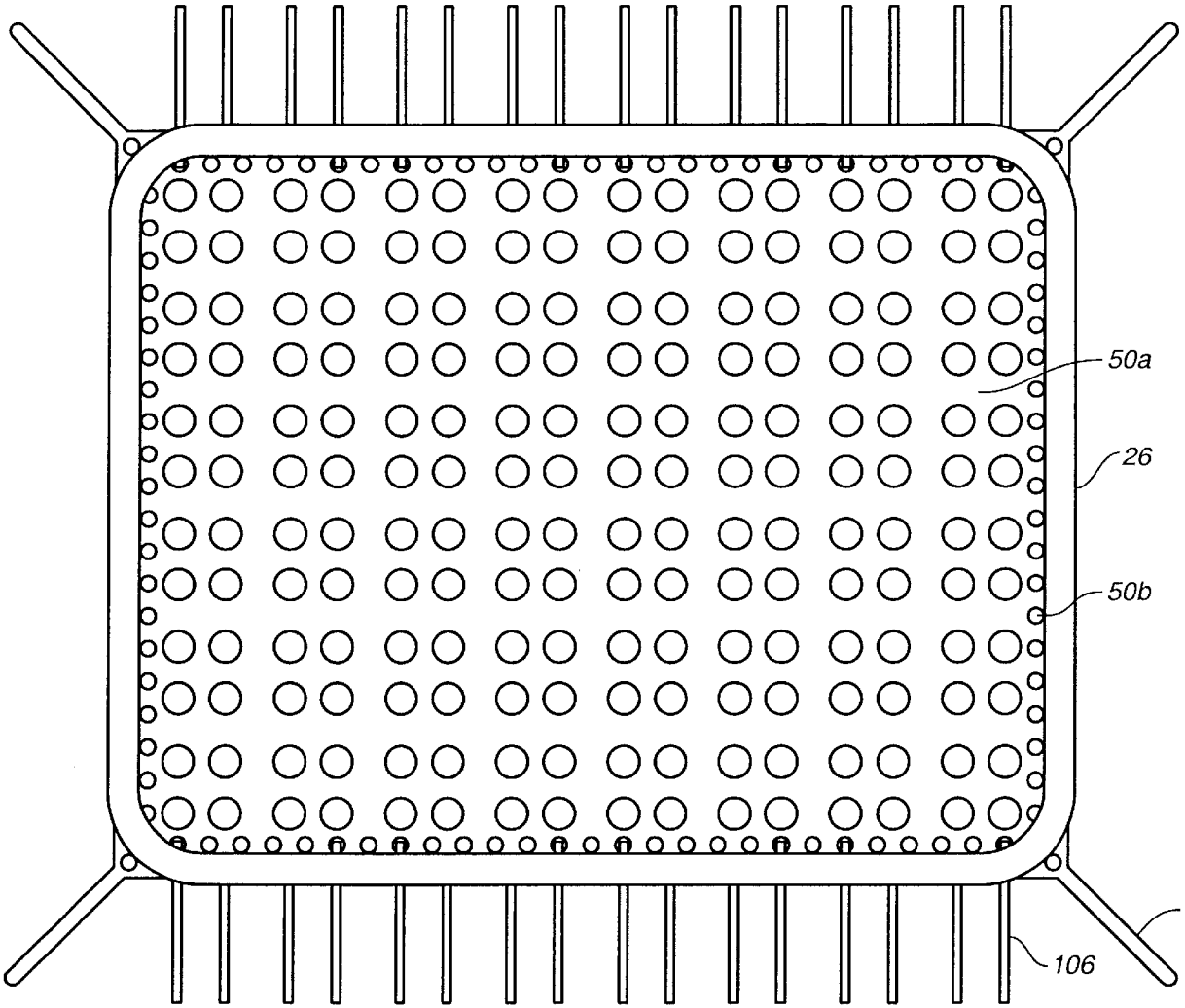
FIG. 8 is a top view of the electrode structure of FIG. 7.

FIG. 7 is a cross-sectional view of the electrode structure 20' of FIGS. 6A, 6B. As shown in FIG. 7, structure 20' includes rim 26 and layer 50 which comprises a center area 50*a* and a perimeter area 50*b* which together form a structure similar to structure 20 of FIGS. 1–6B, and in addition, an insulating layer 104 formed on the side of layer 50 on the opposite side of sealing frame 26, and a control grid electrode layer 102 formed on the insulating layer. Also shown in FIG. 7 are cathode spacers 62 that are formed on the same side of layer 50 as the insulating and control grid electrode layers. In the cross-sectional view of FIG. 7, the crosssection is taken in a direction transverse to the direction of the grid electrodes 102. FIG. 8 is a top view of electrode structure 20' of FIG. 7.

In the embodiment of FIG. 4, two or more sets of grid electrodes may be used for controlling the addressing or brightness of the display. One set of such control grid electrodes may be formed as part of the electrode structure as in structure 20' of FIGS. 7 and 8. When structure 20' is used in the embodiment of FIG. 4, one set of grid electrodes is already formed as part of the electrode structure 20', so that one fewer set of grid electrodes will need to be independently supported and formed as described in U.S. Pat. No. 5,229,691.

Figure 9:
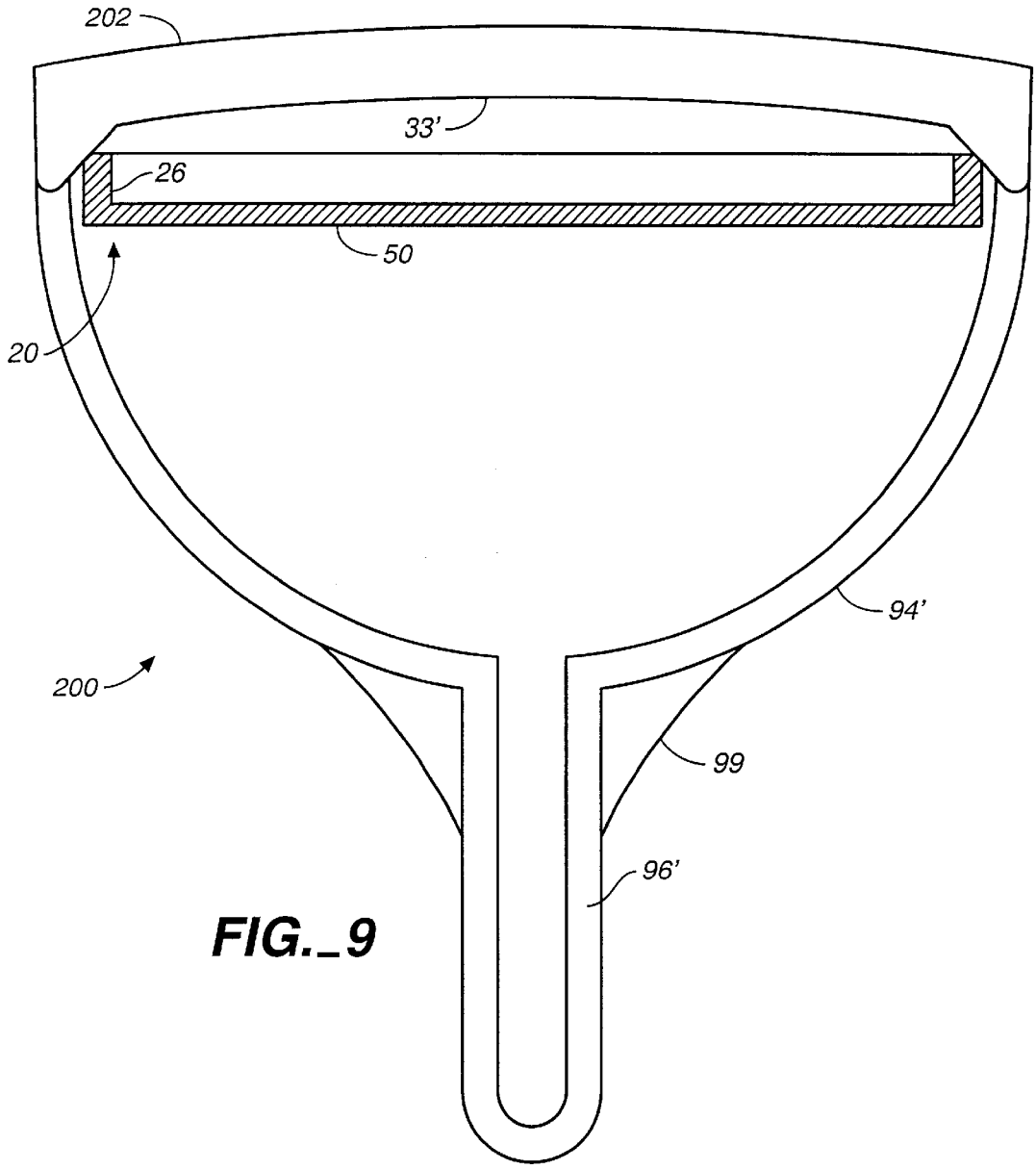
FIG. 9 is a cross-sectional view of a cathode ray tube device employing an electrode structure similar to the electrode structure in the prior embodiments above.

While in the embodiments described above, rim 26 of the electrode structure 20 or 20' forms a portion of the side wall structure of the display itself for enclosing a sealed chamber, it will be understood, however, that this is not necessary and that the rim 26 or any other part of the electrode structure 20 or 20' need not form any portion of the outside housing of the display for enclosing a sealed chamber. Thus, the structure 20 may be used to replace a shadow mask in a cathode ray tube device as illustrated in FIG. 9. As shown in FIG. 9, the cathode ray tube device 200 includes a funnel shaped housing 94' with a neck 96' which encloses an electron source (not shown). As in the embodiment of FIG. 5, electrons emitted by the source are deflected by the magnetic fields generated by a yoke 99, and focused by the voltage applied to layer 50 in structure 20 through the holes (not shown) in layer 50 towards a phosphor layer 33' on the inside surface of a curved front face plate 202. Structure 20 may be first formed. Then structure 20 is attached to the inside surface of front face plate 202 by attaching rim 26 to the inside surface of the front face plate in a manner known to those skilled in the art. As shown in FIG. 9, structure 20 does not form any portion of the side wall of device 200 but is entirely enclosed within the sealed chamber of device 200.

As discussed in the different embodiments above, layer 50 is used as a focusing and/or imaging electrode. To form the layer, a desired pattern of holes for areas 50*a*, 50*b* is etched in a metal sheet. As noted above in reference to FIGS. 6A, 6B, 7 and 8, where grid electrodes are also employed as in structure 20', an insulating layer 104 is deposited onto layer 50 and an additional electrically conductive layer 102 such as metal in the form of a pattern of an array of grid electrodes, as shown in FIGS. 6A, 6B, 7 and 8, is formed on the insulating layer. Cathode spacers 62 are formed first on the side of layer 50. Where the additional insulating and grid electrode layers 104, 102 have been formed on layer 50, the cathode spacers are preferably formed on layer 50 on the same side of such additional layers as shown in FIG. 7. The cathode spacers form on layer 50 a pattern which corresponds to the positions of anode spacers which have not yet been attached to layer 50. Layer 50 together with cathode spacers thereon is then attached to the rim 26 at an elevated temperature, such as a temperature above 365° C. in an oven, to form electrode structure 20.

After the temperatures of the substrate and rim are reduced, such as by withdrawal from an oven, anode spacers are attached to pre-determined locations on the side of the substrate opposite to the cathode spacers, where the pre-determined locations match and overlap the locations of the cathode spacers when viewed from the viewing direction 52 in FIG. 1.

The above-described structure may be used in all of the embodiments described above. For assembling device 10 shown in FIGS. 1, 2A, 2B, 3A, 3B and device 100 of FIGS. 6A, 6B, the back portion of the device is pre-assembled by attaching sealing wall 22 and backplate spacers 24 to a backplate 14. Anode lead 34 is then connected through tube 36 in cathode plate 16 and structure 20 or structure 20' and through hole 28 in the backplate 14 to the anode 32 and the back portion of the backplate 14. The electrode structure 20 or structure 20' with both the anode and cathode spacers thereon is then aligned with respect to the array of FE cathodes on the cathode plate 16 and the pixel dots or elements on the phosphor layer 33 on the anode 32 on the front face plate 12. Rim 26 and anode spacers 60 are then attached to the front face plate 12, and layer 50 and cathode spacers 62 are attached to the cathode plate 16. Backplate spacers 24 and sealing wall 22 are attached to the cathode plate 16 to form devices 10 and 100. Thus, a portion of the cathode plate, rim 26 and sealing frame 22 together form a sidewall structure that encloses a sealed vacuum chamber with the front and back plates, for housing the anode, one or more cathodes and the one or more electrodes (i.e. focusing, and in some embodiments, grid electrodes).

While the invention has been described by reference to various embodiments, it will be understood that modifications and changes may be made without departing from the scope of the invention which is to be defined only by the appended claims and their equivalents.

What is claimed is:

1. A flat panel display device comprising:

a front face plate;

a back plate;

an anode on or near the front face plate;

a layer of luminescent material on or near the anode;

at least one cathode between the front face plate and the back plate;

an electrode structure between the anode and the at least one cathode, said electrode structure including a rim and an electrode connected to the rim, said electrode structure comprising a layer of electrically conductive material under tension, wherein the rim causes tension to be maintained in said layer of electrically conductive material, said electrode structure having a thickness not more than about 3 millimeters; and means for applying electrical potentials to the anode, the layer of electrically conductive material and the at least one cathode to cause electrons from the cathode to reach desired portions of the luminescent layer for displaying images.

2. The device of claim 1, said layer of electrically conductive material including a first material, said rim including a second material, said first material having a thermal coefficient of expansion higher than that of the second material.

3. The device of claim 1, said layer of electrically conductive material including a first material, said rim including a second material, said first and second material having thermal coefficients of expansion greater than about $10\times10^{-7}/°$ C. when the temperature(s) of the first and second material are between 25 to 300° C.

4. The device of claim 1, said layer of electrically conductive material including a first material, said rim including a second material, said first material having a thermal coefficient of expansion in the range of $10\times10^{-7}/°$ C. to $120\times10^{-7}/°$ C. when the temperature of the first material is between 25 to 300° C., and said second material having a thermal coefficient of expansion in the range of $10\times10^{-7}/°$ C. to $250\times10^{-7}/°$ C. when the temperature of the first material is between 25 and 300° C.

5. The device of claim 1, further comprising an adhesive material attaching said electrode structure to the rim, said adhesive having a thermal coefficient of expansion in the range of $10\times10^{-7}/°$ C. to $250\times10^{-7}/°$ C. when the temperature of the adhesive is between 25 to 300° C.

6. The device of claim 1, said layer of electrically conductive material including a metal material, said rim including a glass or ceramic material.

7. The device of claim 1, said electrode structure further comprising a spring connecting the layer of electrically conductive material to the rim.

8. The device of claim 7, said spring comprising a perimeter strip of material with a pattern of holes therein, said strip surrounding the layer of electrically conductive material and adjacent to the rim.

9. The device of claim 8, said strip and said layer of electrically conductive material forming an integral unitary structure.

10. The device of claim 8, wherein said holes in the pattern of holes are substantially hexagonal, circular, square or elliptical in shape.

11. The device of claim 1, said device comprising at least a cathode ray tube.

12. The device of claim 1, said device comprising a plurality of cold cathode field emitters or hot filaments.

13. The device of claim 1, said front and back plates being spaced apart by not more than 10 mm.

14. The device of claim 1, said front and back plates being spaced apart by not more than 25 mm.

15. The device of claim 1, wherein the rim forms at least a portion of a sidewall structure connected to the face and back plates to forth a sealed vacuum chamber housing the anode, at least one cathode and said electrode structure.

16. The device of claim 1, said layer of electrically conductive material including a metal layer, said metal layer comprising at least 40% nickel.

17. The device of claim 1, said device further comprising grid electrodes over the said electrode structure, said applying means applying electrical potentials to the grid electrodes for addressing or brightness control.

18. The device of claim 1, wherein the electrical potential applied to the layer of electrically conductive material causes the electrons to be focused onto the luminescent layer.

19. A flat panel display device comprising:

a front face plate;

a back plate;

an anode on or near the front face plate;

a layer of luminescent material on or near the anode;

at least one cathode on or near the back plate;

an electrode structure between the anode and the at least one cathode, said electrode structure including a rim and an electrode connected to the rim, said electrode structure comprising a layer of electrically conductive material under tension, wherein the rim causes tension to be maintained in said layer of electrically conductive material, said front and back plates being spaced apart by not more than 25 mm, said layer of electrically conductive material and said rim having different thermal coefficients of expansion so that said rim causes the tension to be maintained despite temperature changes; and means for applying electrical potentials to the anode, the layer of electrically conductive material and the at least one cathode to cause electrons from the cathode to reach desired portions of the luminescent layer for displaying images.

20. The device of claim 19, said layer of electrically conductive material including a first material, said rim including a second material, said first material having a thermal coefficient of expansion higher than that of the second material.

21. The device of claim 20, said first and second material having thermal coefficients of expansion greater than about $10\times10^{-7}/°$ C. when the temperature(s) of the first and second materials are between 25 to 300° C.

22. The device of claim 20, said first material having a thermal coefficient of expansion in the range of $10\times10^{-7}/$ C. to $120\times10^{-7}/°$ C. when the temperature of the first material is between 25 to 300° C., and said second material having a thermal coefficient of expansion in the range of $10\times10^{-7}/°$ C. to $250\times10^{-7}/°$ C. when the temperature of the first material is between 25 to 300° C.

23. The device of claim 19, further comprising an adhesive material attaching the electrode structure to the rim, said adhesive having a thermal coefficient of expansion in the range of $10\times10^{-7}/°$ C. to $250\times10^{-7}/°$ C. when the temperature of the adhesive is between 25 to 300° C.

24. The device of claim 19, said layer of electrically conductive material including a metal material, said rim including a glass or ceramic material.

25. The device of claim 19, said electrode structure further comprising a spring connecting the layer of electrically conductive material to the rim.

26. The device of claim 25, said spring comprising a perimeter strip of material with a pattern of holes therein, said strip surrounding the layer of electrically conductive material and adjacent to the rim.

27. The device of claim 26, said strip and said layer of electrically conductive material forming an integral unitary structure.

28. The device of claim 26, said holes in the pattern of holes are substantially hexagonal, circular, square or elliptical in shape.

29. The device of claim 19, said device comprising a plurality of cold cathode field emitters or hot filaments.

30. The device of claim 19, said layer of electrically conductive material including a metal layer, said metal layer comprising at least 40% nickel.

31. The device of claim 19, said device further comprising grid electrodes over the electrode structure, said applying means applying electrical potentials to the grid electrodes for addressing or brightness control.

32. The device of claim 19, wherein the electrical potential applied to the layer of electrically conductive material causes the electrons to be focused onto the luminescent layer.

33. A flat panel display device comprising:

a front face plate;

a back plate;

an anode on or near the front face plate;

a layer of luminescent material on or near the anode;

at least one cathode on or near the back plate;

an electrode structure between the anode and the at least one cathode, said electrode structure including a rim and an electrode connected to the rim, said electrode structure comprising a layer of electrically conductive material;

wherein the rim forms at least a portion of a sidewall structure connected to the face and back plates to form a sealed vacuum chamber housing the anode, at least one cathode and electrode structure; and means for applying electrical potentials to the anode, the layer of electrically conductive material and the at least one cathode to cause electrons from the cathode to reach desired portions of the luminescent layer for displaying images.

34. The device of claim 33, said rim being attached to the face plate, the back plate or a cathode plate to form a portion of a sidewall structure.

35. The device of claim 33, said device further comprising a cathode plate for supporting said at least one cathode, said rim being attached to the face plate to form a portion of a sidewall structure, said device further comprising adhesive means attaching said rim to the cathode plate.

36. The device of claim 33, said layer of electrically conductive material including a first material, said rim including a second material, said first material having a thermal coefficient of expansion higher than that of the second material.

37. The device of claim 33, said layer of electrically conductive material including a first material, said rim including a second material, said first and second material having thermal coefficients of expansion greater than about $10\times10^{-7}/°$ C. when the temperature(s) of the first and second material are between 25 to 300° C.

38. The device of claim 33, said layer of electrically conductive material including a first material, said rim including a second material, said first material having a thermal coefficient of expansion in the range of $10\times10^{-7}/°$ C. to $120\times10^{-7}/°$ C. when the temperature of the first material is between 25 to 300° C., and said second material having a thermal coefficient of expansion in the range of $10\times10^{-7}/°$ C. to $250\times10^{-7}/°$ C. when the temperature of the first material is between 25 to 300° C.

39. The device of claim 33, further comprising an adhesive material attaching the substrate to the rim, said adhesive having a thermal coefficient of expansion in the range of $10\times10^{-7}/°$ C. to $250\times10^{-7}/°$ C. when the temperature of the adhesive is between 25 to 300° C.

40. The device of claim 33, said layer of electrically conductive material including a metal material, said rim including a glass or ceramic material.

41. The device of claim 33, said electrode structure further comprising a spring connecting the layer of electrically conductive material to the rim.

42. The device of claim 41, said spring comprising a perimeter strip of material with a pattern of holes therein, said strip surrounding the layer of electrically conductive material and adjacent to the rim.

43. The device of claim 42, said strip and said layer of electrically conductive material forming an integral unitary structure.

44. The device of claim 42, wherein said holes in the pattern of holes are substantially hexagonal, circular, square or elliptical in shape.

45. The device of claim 33, said device comprising a plurality of cold cathode field emitters or hot filaments.

46. The device of claim 33, said front and back plates being spaced apart by not more than 25 mm.

47. The device of claim 33, said electrode structure having a thickness not more than about 3 millimeters.

48. The device of claim 33, said layer of electrically conductive material including a metal layer, said metal layer comprising at least 40% nickel.

49. A cathode ray tube display device comprising:

a front face plate;

an anode on or near the front face plate;

a layer of luminescent material on or near the anode;

a cathode;

a funnel enclosing the cathode;

means for deflecting an electron beam from the cathode;

an electrode structure between the anode and the cathode, said electrode structure including a rim and an electrode connected to the rim, said electrode structure comprising a layer of electrically conductive material under tension, wherein the rim causes tension to be maintained in said layer of electrically conductive material, said electrode structure having a thickness not more than about 3 millimeters; and means for applying electrical potentials to the anode, the layer of electrically conductive material, the cathode and the deflecting means to cause electrons from the cathode to reach desired portions of the luminescent layer for displaying images.

50. The device of claim 49, said layer of electrically conductive material including a first material, said rim including a second material, said first material having a thermal coefficient of expansion in the range of $10\times10^{-7}/°$ C. to $120\times10^{-7}/°$ C. when the temperature of the first material is between 25 to 300° C., and said second material having a thermal coefficient of expansion in the range of $10\times10^{\times7}/°$ C. to $250–10^{-7}/°$ C. when the temperature of the first material is between 25 and 300° C.

51. The device of claim 49, further comprising art adhesive material attaching the substrate to the rim, said adhesive having a thermal coefficient of expansion in the range of $10\times10^{-7}/°$ C. to $250\times10^{-7}/°$ C. when the temperature of the adhesive is between 25 to 300° C.

52. The device of claim 49, said layer of electrically conductive material including a metal material, said rim including a glass or ceramic material.

53. The device of claim 49, said electrode structure further comprising a spring connecting the layer of electrically conductive material to the rim.

54. The device of claim 49, said spring comprising a perimeter strip of material with a pattern of holes therein, said strip surrounding the layer of electrically conductive material and adjacent to the rim.

55. The device of claim 54, said strip and said layer of electrically conductive material forming an integral unitary structure.

56. The device of claim 54, wherein said holes in the pattern of holes are substantially hexagonal, circular, square or elliptical in shape.

57. The device of claim 49, said layer of electrically conductive material including a metal layer, said metal layer comprising at least 40% nickel.

58. The device of claim 49, said device further comprising grid electrodes over the electrode structure, said applying means applying electrical potentials to the grid electrodes for addressing or brightness control.

59. The device of claim 49, wherein the electrical potential applied to the layer of electrically conductive material causes the electrons to be focused onto the luminescent layer.

60. The device of claim 49, said layer of electrically conductive material including a first material, said rim including a second material, said first and second material having thermal coefficients of expansion greater than about $10\times10^{-7}/°$ C. when the temperature(s) of the first and second material are between 25 to 300° C.

61. The device of claim 49, said layer of electrically conductive material including a first material, said rim including a second material, said first material having a thermal coefficient of expansion higher than that of the second material.

* * * * *